US007803465B2

(12) United States Patent
Colavito

(10) Patent No.: US 7,803,465 B2
(45) Date of Patent: Sep. 28, 2010

(54) STRAND CLADDING OF CALCIUM WIRE

(75) Inventor: Dominick M. Colavito, Bangor, PA (US)

(73) Assignee: Specialty Minerals (Michigan) Inc., Bingham Farms, MI (US)

( * ) Notice: Subject to any disclaimer, the term of this patent is extended or adjusted under 35 U.S.C. 154(b) by 108 days.

(21) Appl. No.: 12/140,636

(22) Filed: Jun. 17, 2008

(65) Prior Publication Data

US 2009/0311553 A1 Dec. 17, 2009

(51) Int. Cl.
*C22C 1/06* (2006.01)

(52) U.S. Cl. ..... 428/555; 219/145.1; 219/146.22; 219/146.23; 75/304; 428/558; 428/649

(58) Field of Classification Search ..... 75/304; 219/145.1, 146.22, 146.23
See application file for complete search history.

(56) References Cited

U.S. PATENT DOCUMENTS 4,127,700 A * 11/1978 Stockel et al. ..... 428/558
4,175,918 A 11/1979 Frantzreb, Sr.
5,079,099 A * 1/1992 Prewo et al. ..... 428/552
5,222,173 A 6/1993 Bausch
5,573,852 A 11/1996 Thal
6,280,497 B1 8/2001 King et al.
6,346,135 B1 2/2002 King et al.
6,560,807 B1 5/2003 Stubler et al.
6,658,684 B2 12/2003 Stubler et al.

FOREIGN PATENT DOCUMENTS

JP 03114689 A * 5/1991

OTHER PUBLICATIONS

International Search Report dated Aug. 3, 2009 for corresponding PCT Application No. PCT/US09/03432.

* cited by examiner

*Primary Examiner*—George Wyszomierski
*Assistant Examiner*—Tima M McGuthry-Banks
(74) *Attorney, Agent, or Firm*—Derek S. Jessen; Leon Nigohosian, Jr.

(57) ABSTRACT

A cored reactive metal wire is formed by gathering at least three strands of continuously fed elongated reactive metal wires into a bundle and aligning the bundle of wires with a continuously fed sheet of metal sheath. The bundle of wires is then compacted into a generally cylindrical shape and clad with the sheet of metal sheath whereby the compacted bundle of reactive metal wires form a core of the cored wire in which the core has a substantially larger diameter than each of the strands of continuously fed elongated reactive metal wires.

18 Claims, 6 Drawing Sheets

STRAND CLADDING OF CALCIUM WIRE

CROSS-REFERENCE TO RELATED CASES

None

FIELD OF THE INVENTION

The present invention relates to fabrication of calcium wires for treating molten metals such as molten ferrous metal.

BACKGROUND

The beneficial aspects of calcium addition to steel have been well known for the purposes of inclusion modification. Various techniques have been used to introduce the calcium into the molten steel bath in a cost effective manner including the addition of bulk calcium and bulk alloy such as calcium silicon, the powder injection of calcium and various alloys and mixtures of calcium metals and the use of wires containing mixtures of calcium and other powders. However, because of the metallurgical properties of calcium, including a high vapor pressure, high buoyancy, low melting and boiling points, adding calcium to a molten steel bath presents a number of problems.

One method of treating molten ferrous material with calcium is continuously feeding steel clad solid calcium cored wires into the surface of the molten metal in steel-making ladles. This will be referred to herein as the surface feeding process. Currently, steel clad solid calcium cored wires are available in a stock of about 8-9 mm diameter calcium core wires and the quantity of calcium required for treating the molten ferrous metal in a steel-making ladles demand that the steel clad solid calcium wires be fed into the molten metal at a high velocity up to 400 feet per minute.

However, because of the high feeding velocity of the calcium cored wire, the release point of the calcium cored wire in the ladle with respect to the injection point is difficult to maintain and control. The release point being where the cored wire melts and becomes liquid bubbles of calcium within the molten ferrous metal.

The relationship between the injection point and the release point of the cored calcium wire can be better controlled if the feeding velocity of the solid calcium wire can be lowered. This can be achieved by increasing the quantity of calcium in the cored calcium wire per unit length. However, current technology for extruding solid calcium metal wire is limited to producing about 8-9 mm diameter stock wires and can not form larger diameter solid calcium wires.

SUMMARY

According to an embodiment of the present disclosure, a method of forming a cored wire is disclosed. The method comprises gathering at least three strands of continuously fed elongated metal wires into a bundle and aligning the bundle of metal wires with a continuously fed sheet of metal sheath material. The bundle of metal wires is then compacted into a generally cylindrical shape. Next, the compacted bundle of wires is clad with the sheet of metal sheath material whereby the compacted bundle of metal wires form a core of the cored wire and wherein the core having a substantially larger diameter than each of the strands of continuously fed elongated metal wires.

The method of the present disclosure allows fabrication of solid calcium cored wire having an effective diameter that is larger than possible with the current extrusion process. This decreases the cost of the calcium wire per unit quantity of calcium. The calcium cored wire made with the method of the present disclosure allows more robust and flexible way of treating molten ferrous metal with calcium cored wire by surface feeding because the lower wire feeding velocity is required for feeding a desired amount of calcium.

According to another embodiment, a cored wire comprises a bundle of at least three compacted reactive metal wire strands forming a core. At least one of the at least three compacted reactive metal wire strands is a calcium wire and a metal cladding sheath encloses the core.

According to yet another embodiment, a cored wire comprises a bundle of at least three compacted reactive metal wire strands forming a core. At least one of the at least three compacted reactive metal wire strands is a calcium wire and a metal cladding sheath encloses the core, whereby interstitial spaces are formed between the metal cladding sheath and the core. The interstitial spaces are filled with one or more reactive metals in granular form.

All figures are schematic illustrations and are not to scale and do not show dimensional relationships.

DETAILED DESCRIPTION

Figure 1:
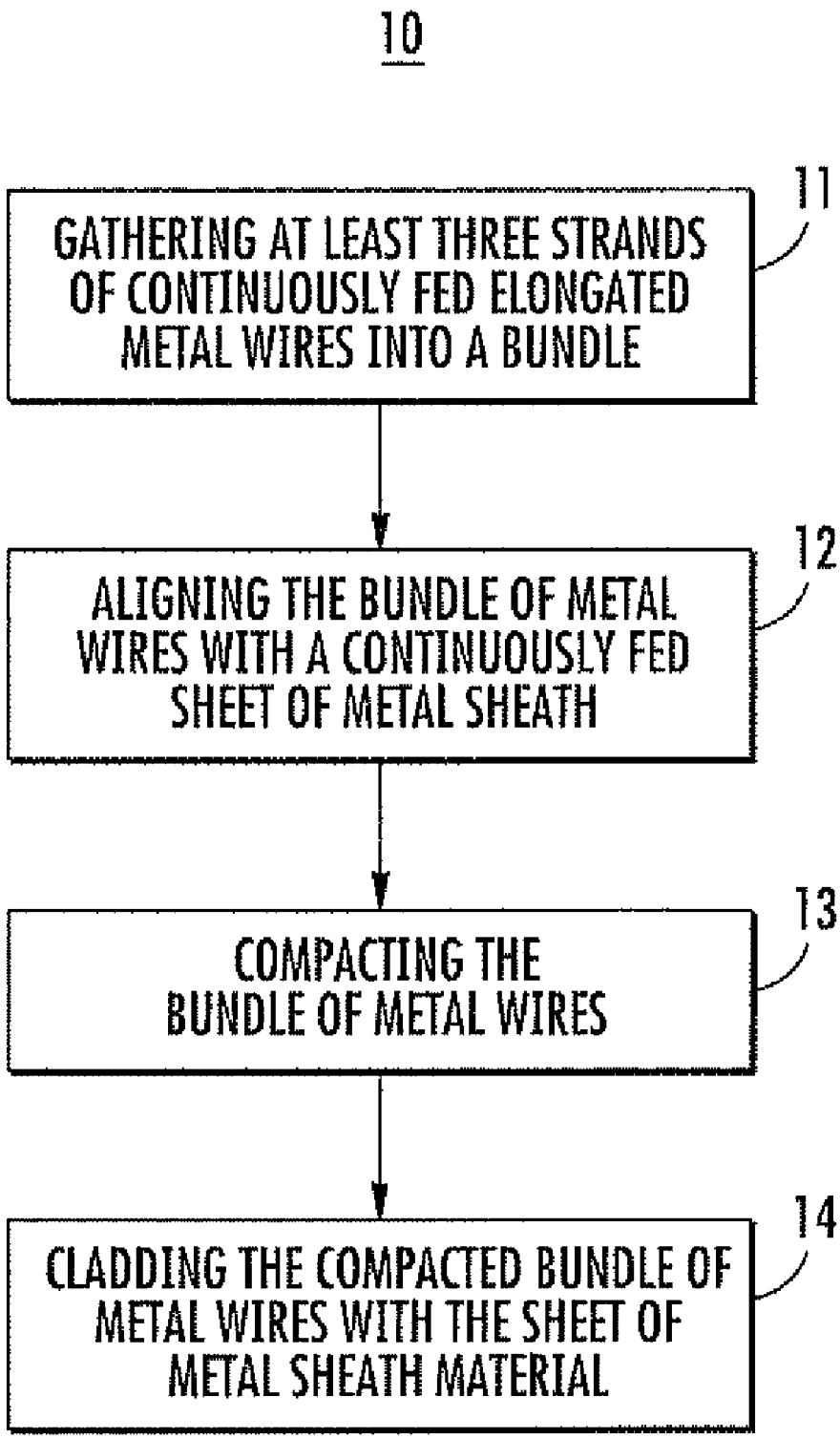
FIG. 1 is a flowchart of the method of the present disclosure according to an embodiment.

FIG. 1 is a flowchart 10 illustration of the method of forming a reactive metal cored wire clad in a steel jacket for treating molten ferrous metal according to the present disclosure. The method of the present disclosure is a continuous process where continuous strands of reactive metal(s) are introduced at the beginning of the process and a continuous cored wire clad in steel jacket exits at the output end of the process. Continuous strands of at least three reactive metal wires are gathered into a bundle (see box 11). The gathering of the least three strands of reactive metal wires produce a bundle of the reactive metal wires in generally parallel orientation to one another.

The bundle of wires is then aligned with a continuously fed sheet of metal sheath material (see box 12). Next, the bundle of wires is compacted into a generally cylindrical shape (see box 13) by passing the aligned bundle of wires and the metal sheath material under a compacting wheel. The compacted bundle of wires is then clad with the steel jacket material (see box 14). The cladding process can be a roll forming process in which the metal jacket material is wrapped over the compacted bundle of wires and sealed by forming a continuous locking seam that runs longitudinally. An example of such roll forming process is described in U.S. Pat. No. 6,346,135 to King et al., the disclosure of which is incorporated herein by reference. This process is particularly beneficial in fabricating steel clad reactive metal wires where the reactive metal is solid calcium metal. This process allows fabrication of steel clad solid calcium metal wires having diameters that are larger than the limit of the currently available extrusion technology for forming solid calcium metal wires.

Figure 2:
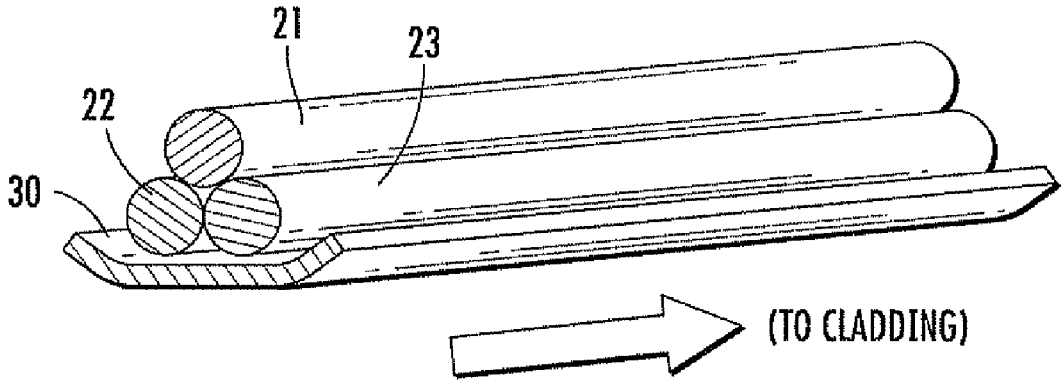
FIG. 2 is a schematic illustration of a bundle of three strands of reactive metal wires that has been aligned with a strip of steel metal jacket material en route to the cladding step.

As shown in FIG. 2, at least three strands of solid calcium metal wires 21, 22, 23 are continuously fed in the direction of the arrow towards the cladding process. In this view the strands of solid calcium metal wires have been gathered into a bundle as they are continuously fed and aligned with a strip of steel sheathing 30 which is also fed in a continuous strip for in the same direction and speed as the calcium metal wires. In order to form a final clad wire product that has a generally cylindrical form and having a reasonably uniform diameter, at least three strands of the reactive metal wires are used for the core as shown.

Figure 3:
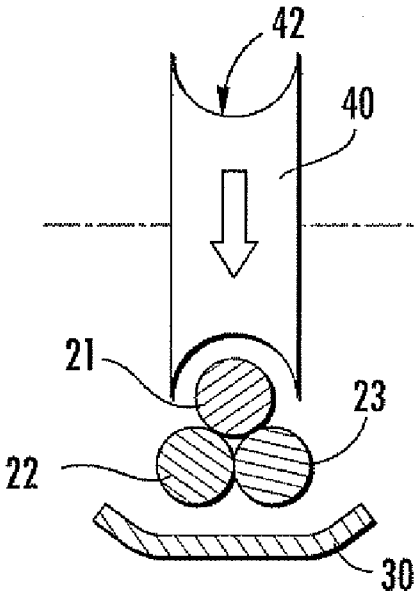
FIGS. 3 and 4 are schematic illustrations of the pre-cladding compacting process of the method of the present disclosure.
Figure 4:
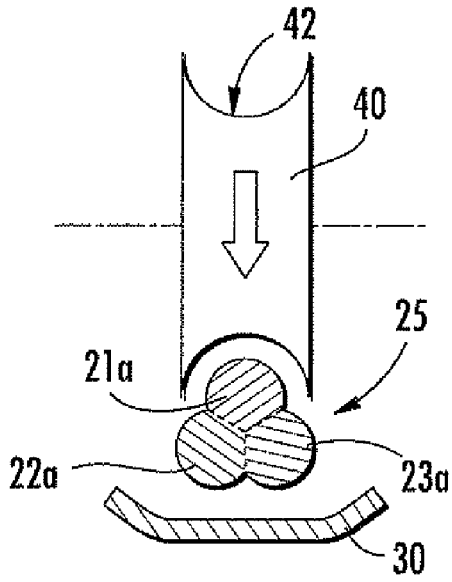

Referring to FIGS. 3 and 4, the strands of solid calcium metal wires 21, 22, 23 are then compacted before reaching the cladding process. A compaction wheel 40 can be used to compact the continuously fed calcium metal wires 21, 22, 23. The compaction wheel 40 applies an appropriate pressure on the strands of calcium wires 21, 22, 23 as the wires strands and the steel sheath material 30 pass under the compaction wheel 40. Preferably, the compaction wheel 40 is configured with a compacting surface 42 that is contoured appropriately to compact the strands of calcium wires 21, 22, 23 into a compacted calcium wire form 25. The compaction pressure causes the strands of calcium wires 21, 22, 23 to slightly plastically deform into the generally cylindrical compacted calcium wire form 25. As shown in FIG. 4, the compacted calcium wire form 25 comprises the deformed calcium wire portions 21*a*, 22*a*, 23*a*.

The compacted calcium wire form 25 and the strip of steel sheath 30 then continue on to the cladding process that wraps the steel sheath 30 around the compacted calcium wire form 25. According to one embodiment of the present disclosure the cladding process can be a continuous roll forming process. Such roll forming process appropriately forms and wraps the strip of steel sheath 30 around the compacted calcium wire form 25, thus forming a steel clad wire having a solid calcium core.

Figure 5:
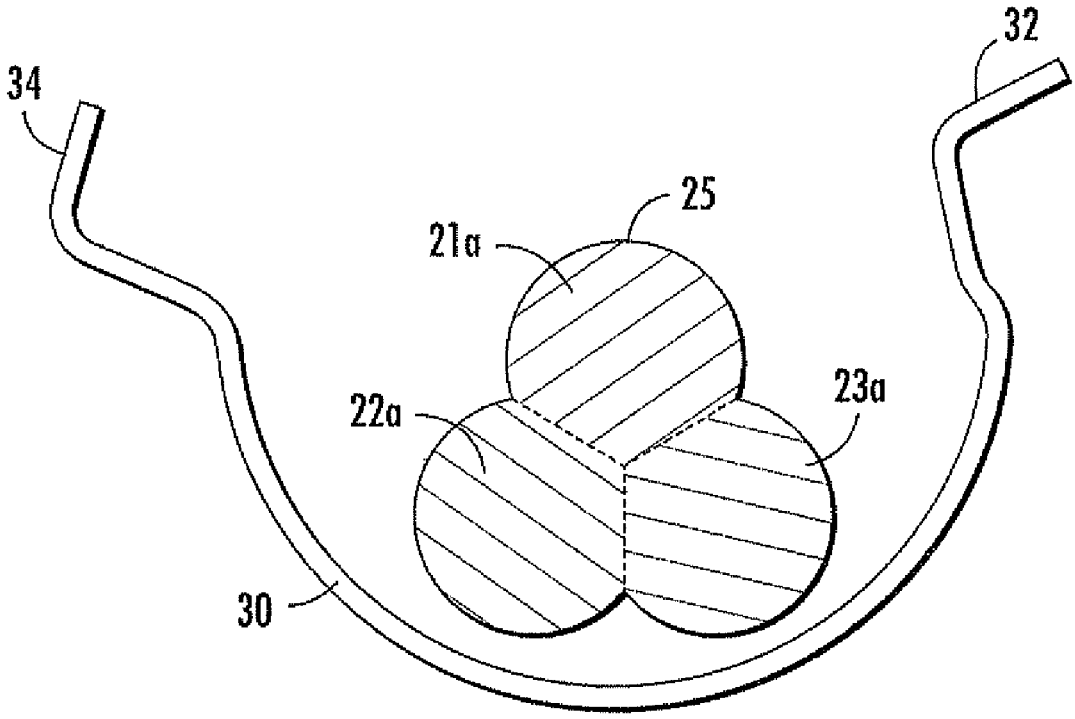
FIG. 5 is a cross-section illustrating a step in the cladding of the compacted strands of the reactive metal wires with a steel sheath according to an embodiment of the present disclosure.

FIGS. 5-9B illustrates this exemplary roll forming process. FIG. 5 illustrates one step in the roll forming process wherein the steel sheath 30 has a trough like configuration with peripheral ends 32 and 34 roll formed to the shape that will eventually form a lock seam that secures the steel sheath around the calcium core 25. The steel sheath 30 is formed in a multi-step roll forming process to the shape shown in FIG. 5. The compacted calcium wire form 25 and the steel sheath 30 continue through successive roll forming steps to achieve the steel clad calcium cored wire 50 shown in FIG. 10.

Figure 6A:
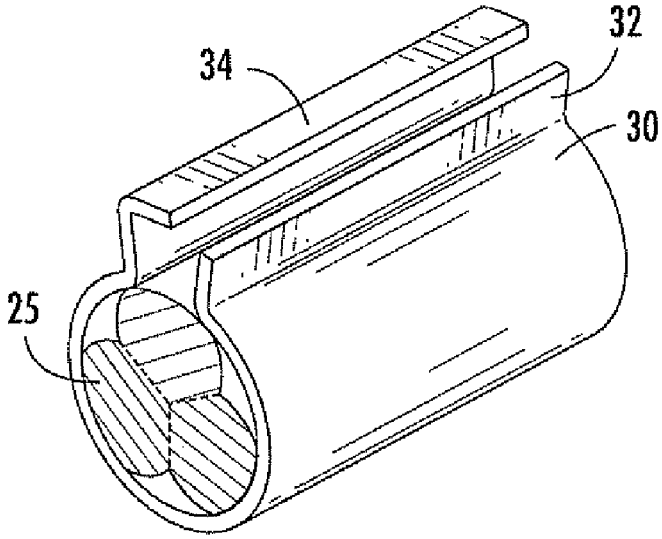
FIGS. 6A, 6B, 7A, 7B, 8A, 8B, 9A and 9B are perspective views and cross-sectional views of various subsequent stages in the cladding of the compacted strands of the reactive metal wires according to an embodiment of the present disclosure.
Figure 6B:
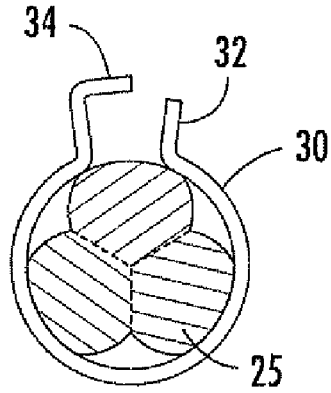
Figure 7A:
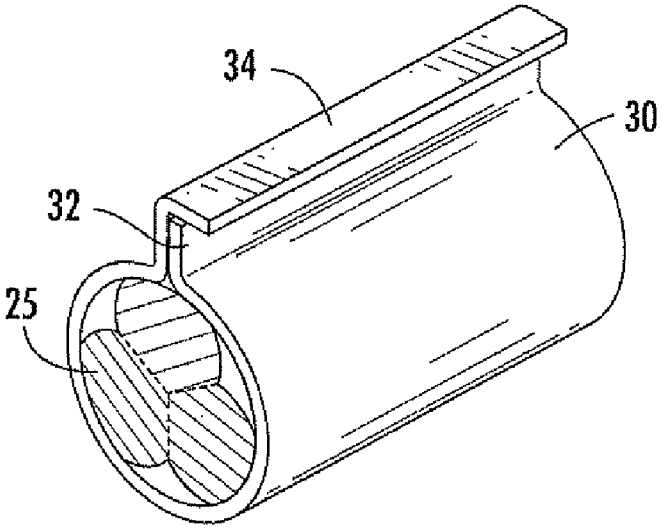
Figure 7B:
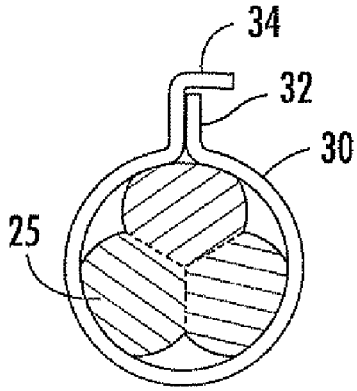
Figure 8A:
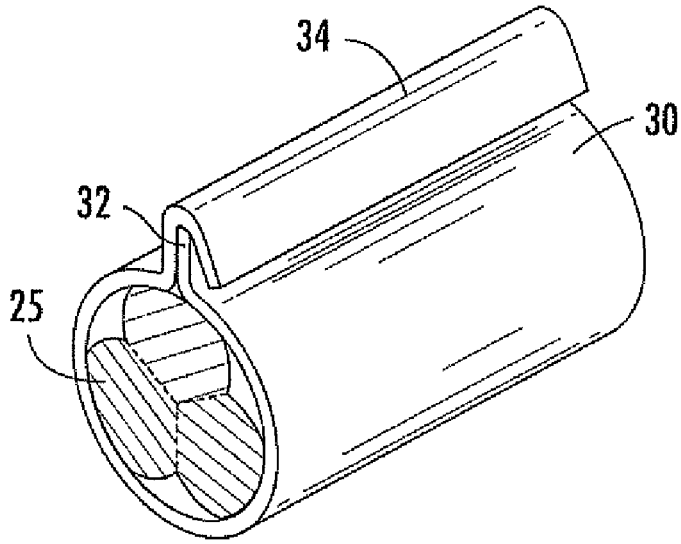
Figure 8B:
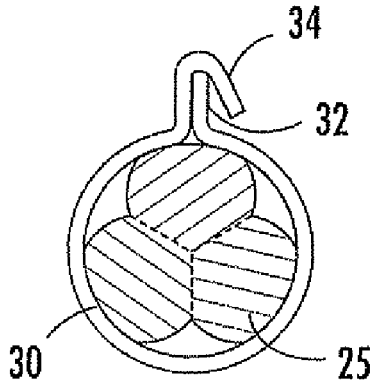

Referring to FIGS. 6A and 6B, the sheath 30 is shown at a step subsequent to the step shown in FIG. 5 wherein the peripheral edges 32, 34 are being brought together so that the vertical portions of the peripheral edges 32, 34 can be mated together as shown in FIGS. 7A and 7B. Peripheral edge 34 has an extended surface portion which is bent at a right angle, to overlay peripheral edge 32 as shown in FIGS. 7A and 7B at this stage of the roll forming process. As shown in FIGS. 8A and 8B, the overlying portion of the peripheral edge 34 is belt bent at an angle that is approximately 45° to vertical or 45° to the mating surfaces of the vertical portions of the peripheral edges 32 and 34.

Figure 10:
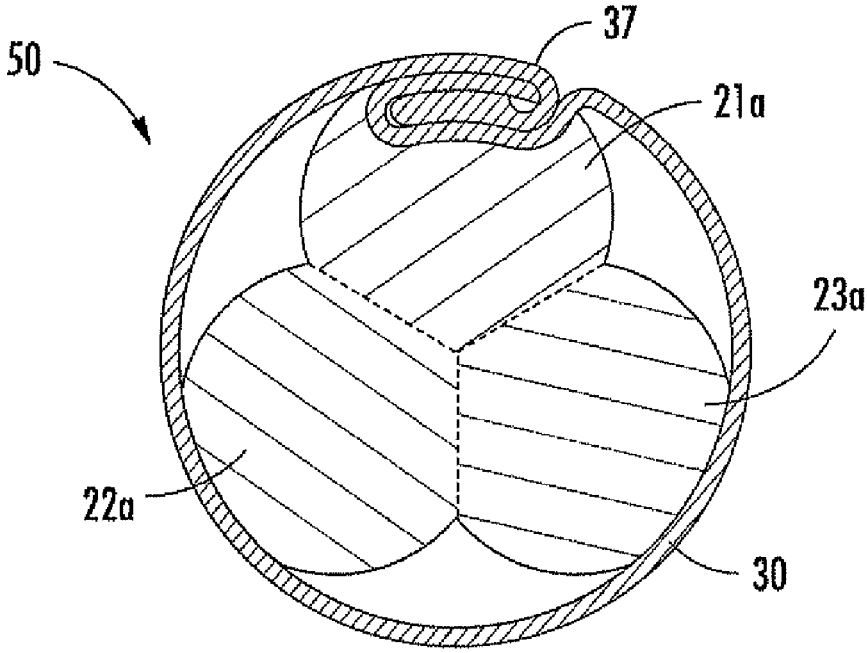
FIG. 10 is a cross-sectional illustration of the finished clad wire according to an embodiment of the present disclosure.
Figure 9A:
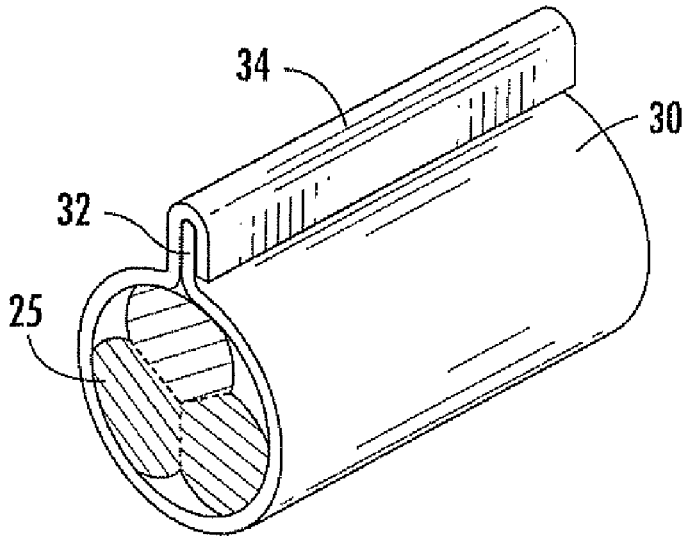
Figure 9B:
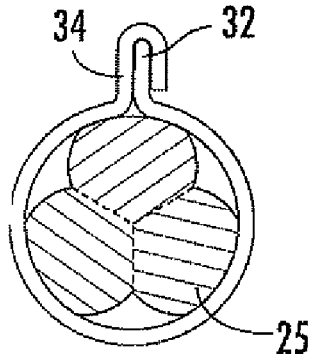

FIGS. 9A and 9B show the next step where the overlying portion of the peripheral edge 34 is folded completely over the vertical portion of peripheral edge 32 and forming a lock seam 37 that extends the length of the wire. Thereafter successive roll forming stages fold down the lock seam 37 over and produce the generally cylindrical shape of the finished wire as shown in FIG. 10.

According to another embodiment of the present disclosure, the at least three strands of the reactive metal wires 21, 22, 23 can be more than one type of reactive metals. For example, the at least three strands comprising the core of the steel clad wire 50 can be a combination of wires of two or more types of reactive metal. In one example, two of the three strands can be calcium metal wires and the third strand can be an aluminum wire. Various combinations of reactive metal types and numbers can be used for the strands of reactive metal wires that form the core of the clad wire 50. According to yet another embodiment, one or more of the at least three strands of wires 21, 22, 23 can be composite metal wires or alloyed metal wires. For example, one or more of the wire strands can be a composite of calcium and aluminum metals or calcium alloy wires. This allows the core or the compacted wire form 25 to be formed with a desired amounts of calcium and aluminum for example. The particular ratio between calcium and aluminum can be adjusted to achieve a desired ratio necessary for the treatment of the molten ferrous metal. The sheath 30 of the clad wire 50 is also not limited to steel and can be varied depending upon the requirements of the final application of the clad wire 50.

Figure 11:
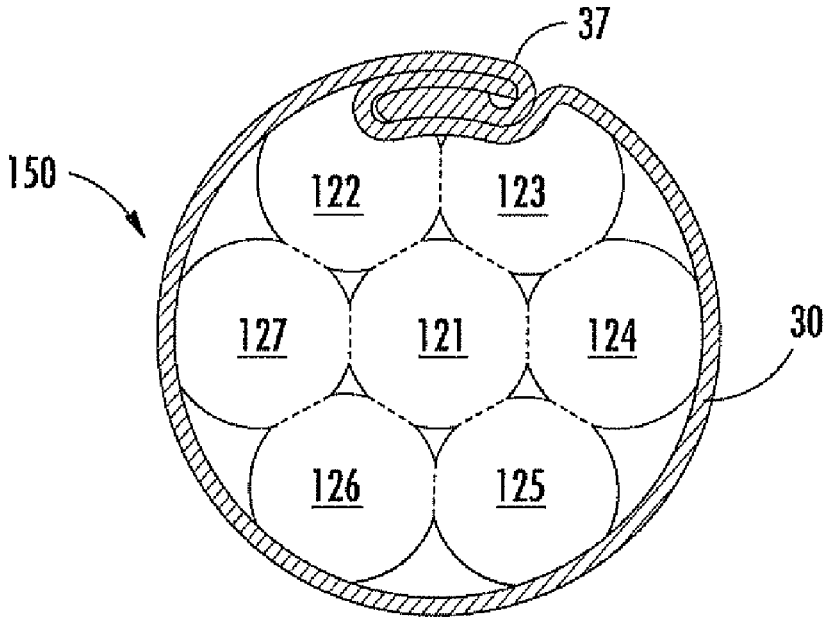
FIG. 11 shows a cross-sectional view of another embodiment of the clad wire of the present disclosure.

According to yet another embodiment, more than three wire strands can be used to make the clad wire. For example, FIG. 11 shows a cross-sectional view of a seven-strand clad wire 150. Compacted strands 121-127 are clad inside the sheath 30.

Figure 12:
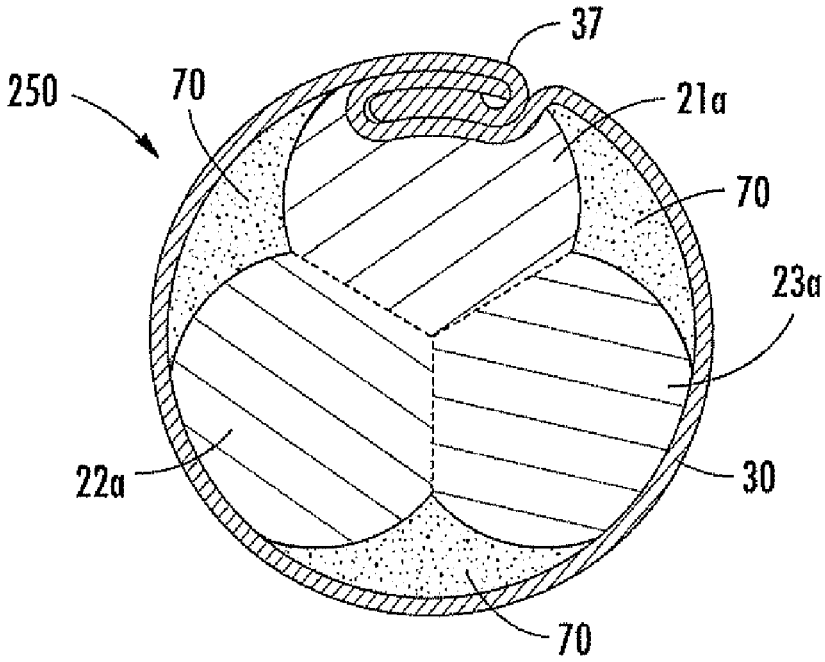
FIG. 12 shows a cross-sectional view of another embodiment of the clad wire of the present disclosure.

FIG. 12 shows a cross-sectional view of another embodiment of a metal sheath clad wire 250 in which the interstitial space between the strands of core wires and the sheath 30 can also be filled with one or more reactive metals 70. The reactive metals 70 can be in granular form. The term "granular" as used herein has a sufficiently broad meaning to encompass particulate form having average diameter of 0.1-1.0 mm as well as more fine powder form. Generally, the granular form would be sufficiently small to substantially fill the interstitial space between the strands of core wires and the sheath 30. As with the strands of wires forming the core, the reactive metals 70 can be calcium or other appropriate reactive metal. In one example, the powder or granular metal 70 is placed within the trough-like form of the sheath 30 shown in FIG. 5 along with the compacted core wire form 25. Then, the sheath 30 is roll formed into the final clad wire form shown in FIG. 12.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A method of forming a cored wire comprising:

gathering at least three strands of continuously fed elongated metal wires into a bundle wherein at least one of the at least three strands of continuously fed elongated metal wires is a calcium metal wire;

aligning the bundle of metal wires with a continuously fed sheet of metal sheath material;

compacting the bundle of metal wires into a generally cylindrical shape; and cladding the compacted bundle of metal wires with the sheet of metal sheath material whereby the compacted bundle of metal wires form a core of the cored wire and wherein the core having a substantially larger diameter than each of the strands of continuously fed elongated metal wires.

2. The method of claim 1, wherein the metal wires are calcium metal wires.

3. The method of claim 1, wherein at least one of the at least three strands of continuously fed elongated metal wires is an aluminum metal wire.

4. The method of claim 1, wherein at least one of the at least three strands of continuously fed elongated metal wires is a composite wire comprising calcium and aluminum.

5. The method of claim 1, wherein the gathering of the least three strands of continuously fed metal wires produce a bundle of the metal wires in parallel orientation.

6. The method of claim 1, wherein the sheet of metal sheath is a steel sheet.

7. The method of claim 1, wherein the cladding of the compacted bundle of metal wires with the sheet of metal sheath material is a roll forming process.

8. A cored wire for introducing a reactive metal into a bath of molten metal, the cored wire produced by:

gathering at least three strands of continuously fed elongated reactive metal wires into a bundle wherein at least one of the at least three strands of continuous fed elongated reactive metal wires is calcium metal wire;

aligning the bundle of reactive metal wires with a continuously fed sheet of metal sheath material;

compacting the bundle of reactive metal wires into a generally cylindrical shape; and cladding the compacted bundle of reactive metal wires with the sheet of metal sheath material whereby the compacted bundle of reactive metal wires form a core of the cored wire and wherein the core having a substantially larger diameter than each of the strands of continuously fed elongated reactive metal wire.

9. The cored wire of claim 8, wherein the reactive metal wires are calcium metal wires.

10. The cored wire of claim 8, wherein at least one of the at least three strands of continuously fed elongated reactive metal wires is aluminum metal wire.

11. The cored wire of claim 8, wherein at least one of the at least three strands of continuously fed elongated reactive metal wires is a composite wire comprising a calcium wire surrounded by an aluminum sheath.

12. The cored wire of claim 8, wherein the gathering of the least three strands of continuously fed reactive metal wires produce a bundle of the reactive metal wires in parallel orientation.

13. The cored wire of claim 8, wherein the sheet of metal sheath is a steel sheet.

14. The cored wire of claim 8, wherein the cladding of the compacted bundle of reactive metal wires with the sheet of metal sheath material is a roll forming process.

15. A cored wire comprising:

a bundle of at least three compacted reactive metal wire strands forming a core, wherein at least one of said at least three compacted reactive metal wire strands is a calcium wire; and a metal cladding sheath enclosing said core.

16. A cored wire comprising:

a bundle of at least three compacted reactive metal wire strands forming a core, wherein at least one of said at least three compacted reactive metal wire strands is a calcium wire;

a metal cladding sheath enclosing said core, whereby interstitial spaces are formed between said metal cladding sheath and said core; and one or more reactive metals in granular form filling said interstitial spaces between the reactive metal wire strands and said metal cladding sheath.

17. The cored wire of claim 16, wherein said one or more reactive metals in granular form comprises calcium.

18. The cored wire of claim 16, wherein said one or more reactive metals in granular form comprises aluminum.

* * * * *